US005988157A

United States Patent [19]

Brown et al.

[11] Patent Number: 5,988,157

[45] Date of Patent: Nov. 23, 1999

[54] FURNACE WITH SPLIT HEAT EXCHANGER

[75] Inventors: Michael N. Brown, Waterloo; Gaetan Roy, St.-Elie D'Orford; Dan C. Dobre, Kitchener, all of Canada

[73] Assignee: 1036684 Ontario Inc. c.o.b. as Clare Brothers

[21] Appl. No.: 09/046,695

[22] Filed: Mar. 24, 1998

[51] Int. Cl.[6] ..... F24H 3/02; F23D 11/36

[52] U.S. Cl. ..... 126/110 R; 126/116 R; 126/110 D; 126/102; 126/112; 126/119; 431/154; 431/189

[58] Field of Search ..... 126/110 R, 99 R, 126/110 D, 114, 116 R, 102, 112, 118, 119; 431/154, 186, 189

[56] References Cited

U.S. PATENT DOCUMENTS

| | | | |
|---|---|---|---|
| 849,890 | 4/1907 | Chromie | 126/102 |
| 913,496 | 2/1909 | Heckler et al. | 126/102 |
| 2,329,920 | 8/1943 | Loveley | 126/116 R |
| 2,389,264 | 11/1945 | Livar | 126/116 R |
| 2,561,100 | 7/1951 | Dahlstrom | 126/110 R |
| 2,793,638 | 5/1957 | Walter | 126/102 |
| 2,805,659 | 9/1957 | Salter | 126/102 |
| 3,260,836 | 7/1966 | Villeneuve | 126/102 |
| 4,203,415 | 5/1980 | Gruber et al. | 126/110 R |
| 4,243,014 | 1/1981 | Hunt | 126/119 |
| 4,275,705 | 6/1981 | Schaus et al. | 126/110 R |
| 4,620,490 | 11/1986 | Brady et al. | 126/190 |

*Primary Examiner*—Ira S. Lazarus
*Assistant Examiner*—Josiah C. Cocks
*Attorney, Agent, or Firm*—Bereskin & Parr

[57] ABSTRACT

A furnace having improved heat exchanger, which is particularly suitable for use in a positive pressure, direct-vented hot air furnace. The heat exchanger has a split housing construction allowing the heat exchanger to be partible into halves. Parting the heat exchanger housing of the present invention permits access to the ceramic combustion chamber disposed therein, facilitating periodic repair and replacement. The partible portions of the present heat exchanger housing are connectable using one of several available connection means, including bolted mating flanges, encircling clamps, and twisting quick-locking means. The connection between the partible portions is gasketed to provide a positive pressure seal of the connection, impeding leakage of pressurized combustion gases from within the heat exchanger to the occupied air.

11 Claims, 8 Drawing Sheets

FURNACE WITH SPLIT HEAT EXCHANGER

FIELD OF THE INVENTION

The present invention relates to hot air furnaces and other fluid heaters, and particularly to improved heat exchangers therefor.

BACKGROUND OF THE INVENTION

Heating appliances, such as oil-fired furnaces, boilers and water heaters, often have "drum-style" heat exchangers which house a combustion chamber or fire pot. Drum-style heat exchangers are usually cylindrical, however heat exchangers having rectangular or polygonal-prismatic shapes are also known. The combustion chamber is typically composed of a ceramic material and is configured to surround the burner flame to evenly distribute heat within the heat exchanger and to increase the temperature in the combustion zone. A fluid, such as air, is circulated around the heat exchanger for heating and subsequently distributed or stored elsewhere. Cool fluid is returned to the device for heating.

In operation, the combustion chamber is subjected to extreme heat, sometimes in excess of 1500° C., which inevitably causes degradation of the chamber. Therefore it is necessary to provide access to, and permit removal of, the combustion chamber for periodic maintenance, repair and replacement, as required.

Conventional hot-air furnaces having drum-style heat exchangers typically include a rectangular cross-sectioned horizontal duct, extending from a lower housing portion of the heat exchanger to the outside casing of the furnace, through which the combustion chamber may be removed for servicing. Such a design is disclosed in U.S. Pat. No. 2,389,264 to Livar. This design, however, blocks the flow of air around a portion of the heat exchanger, thereby reducing the efficiency of the heat exchanger. As the market prices for fossil fuels continually increase, there is an ever-increasing need for improved efficiency heaters.

The rectangular cross-sectioned horizontal duct of the prior art has further disadvantages. With the advent of side wall-vented furnaces, also known as direct-vented furnaces, the combustion gases within the heat exchanger are pressurized in relation to the air outside the heat exchanger. The presence of a positive pressure inside the heat exchanger necessitates a heat exchanger having a complete pressure seal to prevent combustion gases from leaking into the circulation air and endangering the health and safety of building occupants. There is no similar concern in chimney-vented furnaces, since combustion gases in the heat exchanger are maintained at a negative pressure in relation to the circulation air, and any leaks in the heat exchanger simply result in circulation air being drawn into the heat exchanger. When used in a direct-vented furnace, however, the large opening of the rectangularly-ducted heat exchanger of the prior art is disadvantageous because the rectangular access to the duct is difficult to completely pressure seal. Pressure sealing this prior art heat exchanger design requires careful placement of many fasteners, as well as gasketing, around the perimeter of the opening, which results in increased material and labour costs in manufacture. Accordingly, there is also a need for a heat exchanger facilitating easier means for providing a pressure seal therefor.

SUMMARY OF THE INVENTION

In one aspect the present invention is directed to a furnace for heating air comprising:

(a) a casing having a base, a top and side walls, the casing forming an enclosure having an interior circulation air space, and a cool air inlet and a warm air outlet;

(b) circulation means for introducing circulation air to the enclosure through the cool air inlet and removing circulation air from the enclosure through the warm air outlet;

(c) a heat source, comprising a burner and a combustion chamber located in the casing, the burner producing heat for heating the combustion chamber;

(d) a heat exchanger disposed within and spaced from the side walls of the casing for transferring heat from the combustion chamber to the circulation air, comprising a heat exchanger housing having an upper portion and a lower portion, and connection means for releasably connecting the lower portion to the upper portion, the lower portion being configured and sized to receive the combustion chamber;

(e) access means formed, in one of the side walls of the casing, for providing access to the connection means, the access means comprising an accessway, configured and sized to permit removal of the lower portion of the heat exchanger from the enclosure therethrough when the connection means is released, and a cover for removably covering the accessway, the access means thereby permitting the lower portion of the heat exchanger to be separated from the upper portion and removed from the enclosure through the accessway, thereby facilitating servicing of the combustion chamber exterior to the casing.

In a second aspect, the present invention is directed to a heat exchanger for use in a hot air furnace, the furnace having an enclosure and means for flowing air into the enclosure and then out of the enclosure, a combustion chamber positionable inside the enclosure to be in contact with the air flow, the furnace having a heating member for heating the heat exchanger, the heat exchanger comprising:

(a) a housing having a first portion and a second portion, the first and second portions joinable by a releasible connection, the second portion having an interior configured and sized to house the heating member; and (b) a heat exchanging wall for transferring heat from the interior, wherein the second portion of the housing is releasible from the first portion, the interior of the housing being accessible when the connection is released.

BRIEF DESCRIPTION OF THE DRAWINGS

For a better understanding of the present invention, and to show more clearly how it may carried into effect, reference will now be made, by way of example only, to the accompanying drawings illustrating the preferred embodiments of the present invention, in which.

DETAILED DESCRIPTION OF THE PREFERRED EMBODIMENTS

Figure 1:
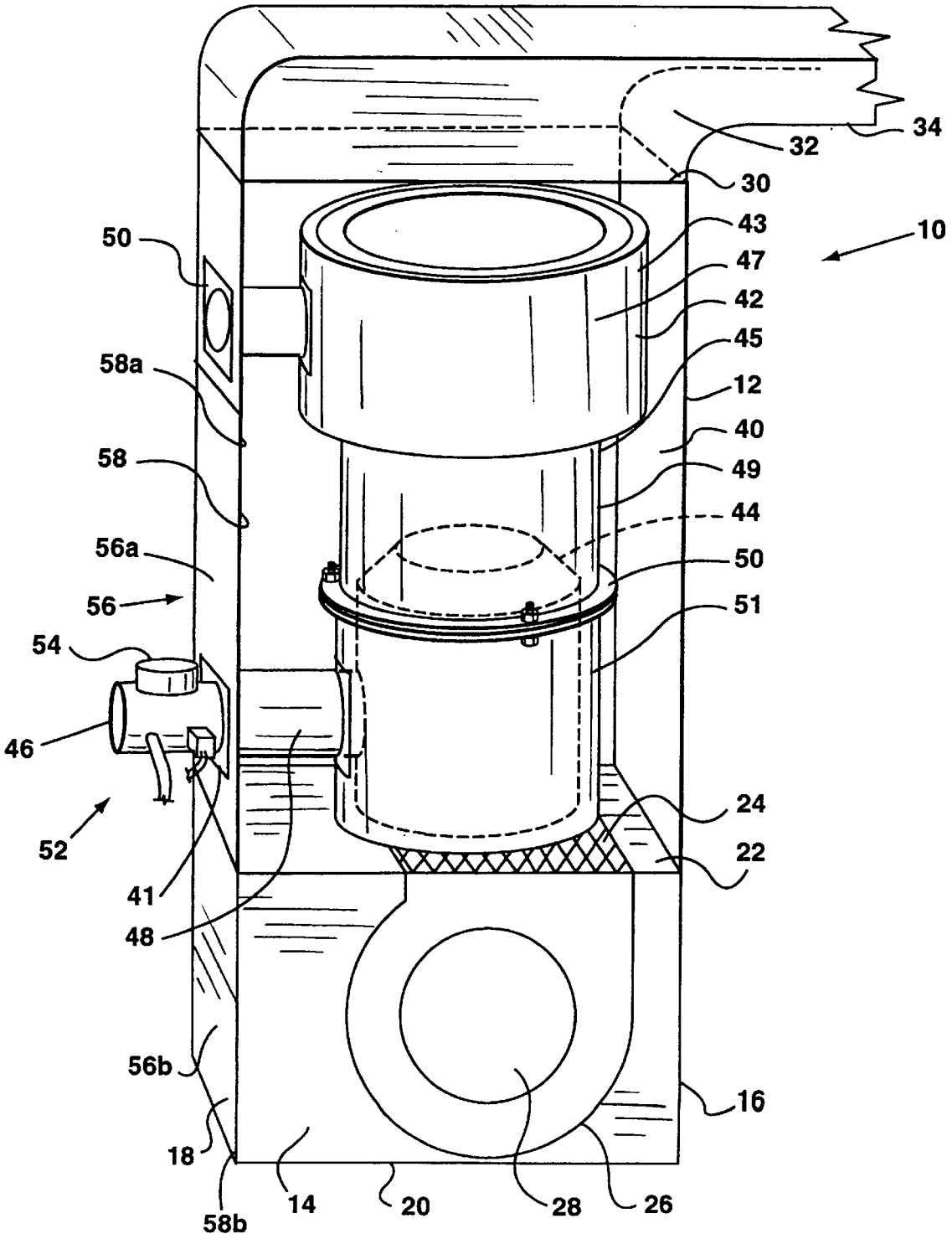
FIG. 1 is an isometric view of a hot-air furnace according to the present invention, with a portion removed to show the heat exchanger therein.

FIG. 1 illustrates a preferred embodiment of a hot-air furnace 10 made in accordance with the present invention. Furnace 10 has a casing 12, comprising side walls 14, rear wall 16 and front wall 18 which are suitably fastened to, and rise from, a base 20. Front wall 18, as will be described below, is preferably removable, either in whole or in part, to provide access to the interior of casing 12. Interior to casing 12, and spaced above base 20, is a floor 22, having an opening 24. Connected to opening 24 is a discharge end of a centrifugal fan or blower 26 disposed thereunder. Blower 26 receives air via a cool air inlet 28. Air entering inlet 28 is typically filtered with a replaceable filter (not shown). Blower 26 is powered by motor (not shown) which is typically electric, and blower 26 may either be directly driven by such motor, or may be belt driven (not shown).

The upper edges of walls 14, 16 and 18 define a warm air outlet opening 30, to which is connected a plenum 32. Plenum 32 empties into an outlet duct 34 which carries heated air away from furnace 10 for use in a typical forced air heating system (not shown) within a building. Such air heating system has a cool air return for supplying cool air to air inlet 28 of blower 26. Heating systems suitable for use with furnace 10 are well known in the art and need not be discussed further here.

Floor 22 and walls 14, 16 and 18 define an enclosure 40 within casing 12. Within enclosure 40 is a drum-style heat exchanger 42, which is typically cylindrical in shape, as shown in FIG. 1, although heat exchanger 42 could be rectangularly-prismatic or polygonally-prismatic shaped or other shape which exhibits advantageous heat transfer characteristics. In the preferred embodiment, heat exchanger 42 comprises a cylindrical radiator 43 and a primary heat exchanger 45, also cylindrical but of smaller diameter. Heat exchanger 42 has a heat exchanging wall 47, in contact with circulation air within enclosure 40.

Primary heat exchanger 45 comprises an upper primary heat exchanger 49 and separable lower primary heat exchanger 51. Upper primary heat exchanger 49 and lower primary heat exchanger 51 are releasably connected to one another by a connection 53. Connection 53 may be any one of several configurations, as is described in more detail below. Connection 53, when connected, provides a pressure seal, described below, between upper primary heat exchanger 49 and lower primary heat exchanger 51. Such seal impedes inadvertent leakage of combustion gases from heat exchanger 42, preventing mixing of such gases with circulation air present in enclosure 40.

Connection 53 is preferably positioned to correspond, when installed, to a position near the top of a combustion chamber 44, which is located in lower primary heat exchanger 51, to reduce the heat to which connection 53 is subjected. As will be understood by one skilled in the art, the heat exchanging wall 47 temperature decreases towards the bottom of heat exchanger 42, as combustion chamber 44 acts as an insulator to the combustion heat. To maintain the sealing and structural integrity of connection 53, it is desirable to minimize the temperature of such connection. As the location of connection 53 is moved further down heat exchanger 42, however, more clearance is required between lower primary heat exchanger 51 and floor 22, once connection 53 is released, to permit removal of combustion chamber 44 from upper primary heat exchanger 49. Increasing this distance necessarily increases the overall height of furnace 10. Accordingly, the optimum position for connection 53 on heat exchanger 42 will depend on the heat which the structure or a particular connection 53 configuration can withstand, and the amount of clearance within enclosure 40 is available for the removal of lower primary heat exchanger 51 and combustion chamber 44 from upper primary heat exchanger 49, and casing 12.

Heat exchanger 42 may be fabricated of any material which is suitable and adaptable for use in a hot-air furnace. Typically, the interior of heat exchanger 42 is subjected to temperatures of up to 1000° C. and, obviously, heat exchanger 42 must therefore be constructed to withstand such temperatures. In the preferred embodiment, heat exchanger 42 is fabricated from heavy gauge steel, preferably about 16 gauge steel.

As stated, combustion chamber 44 is located within heat exchanger 42, and positioned within lower primary heat exchanger 51. Combustion chamber 44 is typically composed of a ceramic or other refractory material, although metal constructions are known, and is provided to distribute heat more evenly within heat exchanger 42 and to increase the temperature around the combustion zone. A burner assembly 46, positioned outside of casing 12, is provided to heat combustion chamber 44. Burner assembly 46 is connected to, and in flow communication with, combustion chamber 44 via an combustion air tube 48. Air combustion tube 48 is sealably attached at one end to lower primary heat exchanger 51, preferably by welding, and has a burner mounting plate 41 at the other end. A combustion gas vent 50 is provided at an upper portion of heat exchanger 42 for evacuating combustion gases from heat exchanger 42.

Typically burner assembly 46 comprises a fuel supply line, fuel pump, burner blower and electrical connection, located generally at 52. Burner assembly 46 also comprises a combustion air intake 54. An electrode (not shown) is disposed interior to combustion air tube 48. The remainder of burner assembly is disposed exterior to casing 12, mounted in front of access panel 56, as described in more detail below.

Burner assembly 46 is preferably supplied with home heating oil, although any combustible fuel may be used in conjunction with an appropriate burner construction. Burner assembly 46 also comprises suitable systems (not shown), as are known in the art, to provide fuel feed rate control, thermostatic control and the like. It is also desirable, as will be understood by one skilled in the art, to have such control system control the operation and speed of blower 26. The burner assembly and related systems form no part of the present invention and need not be described further here.

Access to heat exchanger 42 is gained through front wall 18 via an access panel 56 releasably covering an access opening 58. Access panel 56 may comprise substantially all of front wall 18, or may comprise only a portion thereof. In the preferred embodiment, access panel 56 comprises the entirety of front wall 18, and has two pieces, upper panel 56*a* and lower panel 56*b*, covering access openings 58*a* and 58*b* respectively. Access opening 58*a* is of sufficient size and configuration, to permit the removal of lower primary heat exchanger 51 from furnace 10 therethrough, as described below. Access opening 58*b* provides access to blower 26 for servicing thereof. Access panels 56*a* and 56*b* may be attached to casing 12 by any means known in that art, such as through a hook-and-slot arrangement, by fastening screws to a connection flange, or other means. Unlike the prior art, panel 56*a* need not necessarily provide a complete pressure seal of opening 58*a*, however, for reasons which will become apparent below.

In operation, an appropriate control system (not shown) in use in conjunction with furnace 10 activates burner assembly 46, which causes an air and fuel mixture to be combusted at or near exit of air tube 48, in the interior of combustion chamber 44. Fresh air is provided to burner assembly 46 via a combustion air intake 54. Combustion air intake 54 and vent 50 are connected to suitable air intake and venting systems, respectively, as are known in the art, to supply fresh air to furnace 10 and vent combustion gases to the exterior of the building.

The combustion of fuel within combustion chamber 44 results in a heating of chamber 44, and resulting radiation and convection cause combustion air within heat exchanger 42 to be heated. Simultaneously, blower 26 feeds cool circulation air into enclosure 40 through opening 24, the air being forced by blower 26 upwardly around heat exchanger 42 and over the outside surface of heat exchanging wall 47. As circulation air passes along wall 47, heat is transferred through wall 47 from combustion air within heat exchanger 42 to circulation air in enclosure 40. The warm circulation air is subsequently forced from enclosure 40 into plenum 32 by blower 26, and subsequently to outlet duct 34 for delivery to a heating system in the building.

As discussed above, periodically, repair or replacement of combustion chamber 44 is required, and access thereto must therefore be provided. Typically, complete removal of combustion chamber 44 from heat exchanger 42 and casing 12 is desired. Such removal is achieved through the execution of the following steps. Burner assembly unit 46 is first removed from the face of access panel 56*a* by release from burner mounting plate 41. Access panel 56*a* is then removed from front wall 18 of casing 12 and, once panel 56*a* has been removed, access to heat exchanger 42, and particulary connection 53, is permitted. Connection 53 is then released, the mechanics of such release depending on the particular configuration of connection 53, as will be described in more detail below. Preferably, connection 53 permits full detachment of lower primary heat exchanger 51 from upper primary heat exchanger 49. Where a fully detachable connection 53 is provided, lower primary heat exchanger 51, with combustion chamber 44 located therein, is detached and then lowered and withdrawn horizontally through access opening 58*a*. Combustion chamber 44 may then be removed from lower primary heat exchanger 51 and repair, etc. may be effected.

Once repair or replacement is complete, heat exchanger 42 is reassembled, with repaired/replaced combustion chamber 44 therein, by repeating, in reverse order, the steps described above. Access panel 56*a* is then replaced and burner assembly 46 is reinstalled. After the completion of any set up and/or testing measures made necessary by the particular repair or replacement undertaken, furnace 10 is again ready for normal operation.

Figure 2:
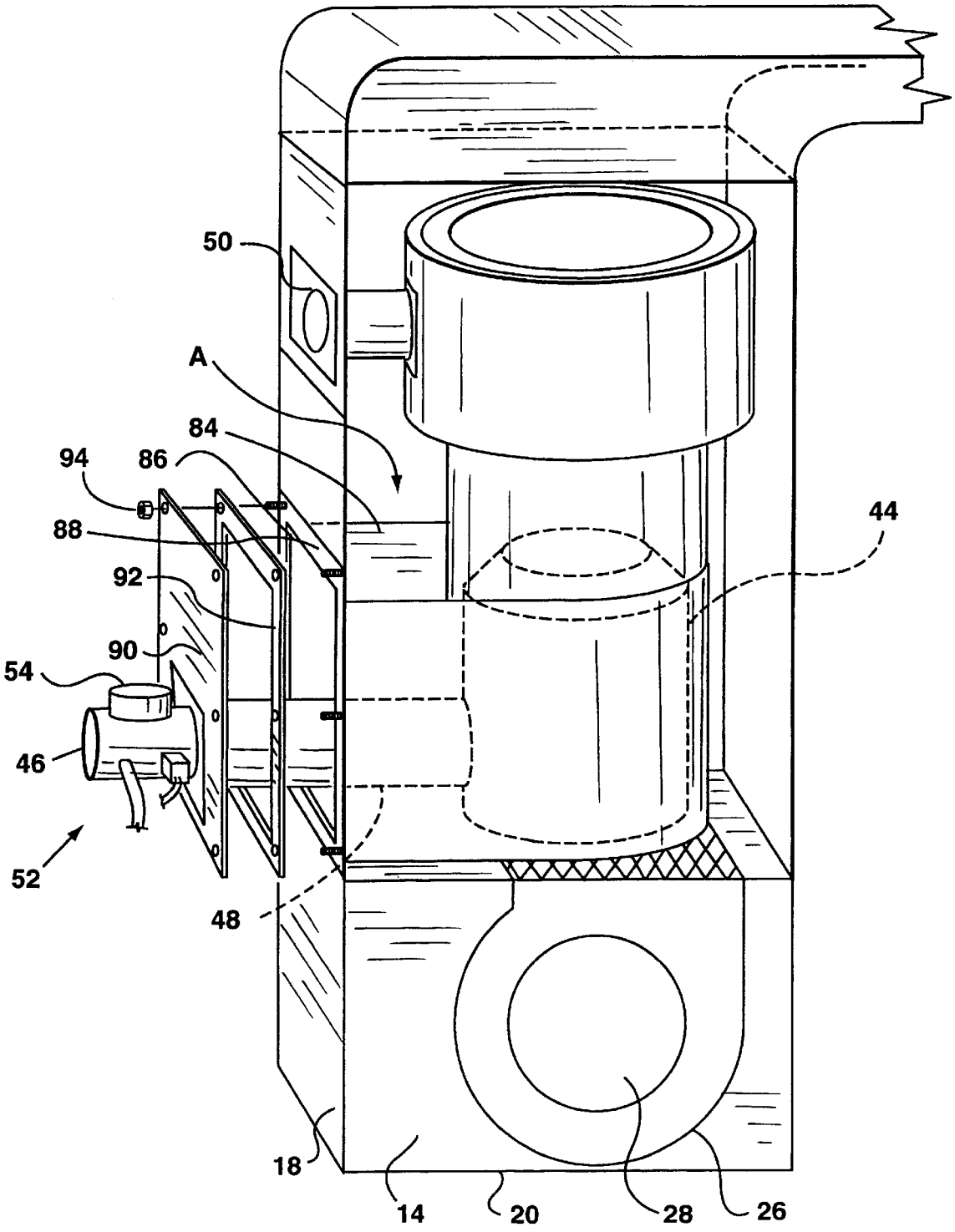
FIG. 2 (Prior art)
FIG. 2 is an isometric view of a hot-air furnace according to the prior art, with a portion thereof removed to show a prior art heat exchanger disposed therein.
Figure 3:
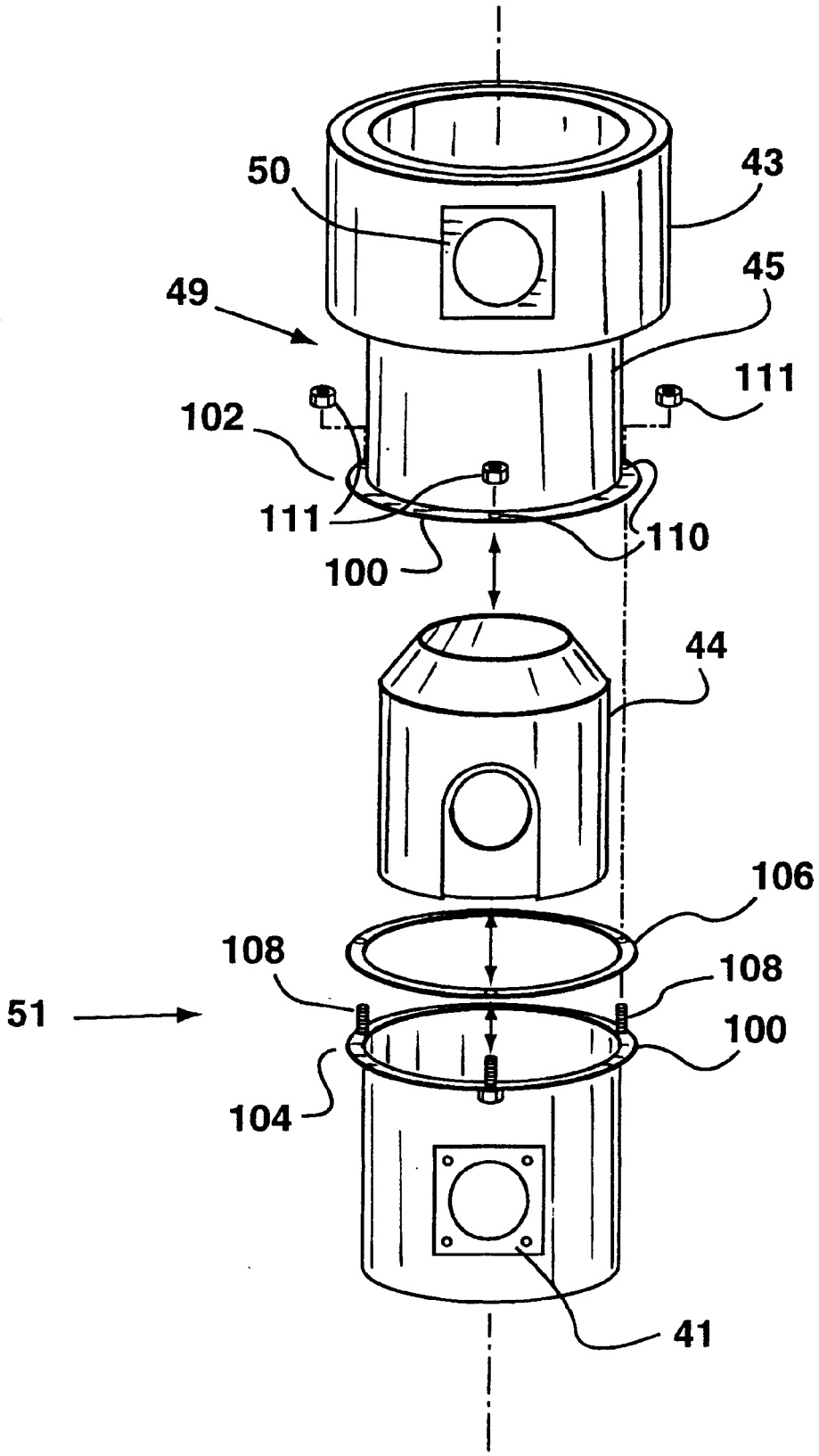
FIG. 3 is an exploded side view of the heat exchanger of the device of FIG. 2 showing an embodiment of the connection means of the present invention.

Referring to FIG. 2, a furnace 80 having a heat exchanger 82 according to the prior art is shown. Prior art furnace 80 provides access to chamber 44 through a rectangular cross-sectioned duct 84, attaching to a lower housing portion of heat exchanger 82 and extending to an opening 86 in front wall 19 defined by a flange 88. Opening 86 is sealably closed by a burner plate 90. A gasket member 92 is provided between plate 90 and flange 88, and fasteners 94 are provided around the periphery of plate 90 to ensure a proper pressure seal between plate 90 and flange 88. Fasteners 94 typically comprise nut and bolt pairs or other threaded fastener arrangements. Burner assembly 46 is mounted to plate 90.

Removal of combustion chamber 44 is achieved in prior art furnace 80 by the sequential removal of burner assembly 46 from burner plate 90, and burner plate 90 from flange 88. Combustion chamber 44 is then laterally withdrawn through duct 84 to the exterior of casing 12. Repair or replacement of chamber 44 may then be made. The repaired or replaced unit is reinstalled, re-aligned, and furnace 80 reassembled, by following the steps described for disassembly, in reverse order.

When furnace 80 is in operation, air entering enclosure 40 and flowing upwardly around heat exchanger 82 is blocked by duct 84 from flowing around a portion of heat exchanger 82, indicated by reference letter A. Such blockage inevitably reduces the efficiency of heat exchanger 82. A further disadvantage of furnace 80 is that, due to the size and shape of opening 86 and plate 90, it is difficult to achieve a complete pressure seal of heat exchanger 82. Gasketing 92, in conjunction with the careful placement of numerous fasteners 94 around burner plate 90, is required thereby increasing labour and material costs in manufacturing furnace 80. Yet another disadvantage of furnace 80 of the prior art is that heat exchanger 82 is not isolated from the exterior of furnace 80 at cover plate 90. Accordingly, cover plate 90 must be heavily insulated to prevent presenting a burn hazard to persons touching the exterior of cover plate 90. Still a further disadvantage furnace 80, as will be appreciated by one skilled in the art, is the difficulty in constructing heat exchanger 82, wherein rectangular duct 84 must be attached, usually by welding, to a cylindrical heat exchanger 82.

Referring again to FIG. 1, when used in conjunction with a direct-vented furnace 10 made in accordance with the present invention, combustion gases within heat exchanger 42 may be at a greater pressure than circulation air in enclosure 40. Pressure sealing of the heat exchanger 42 of the present invention is simpler than with the prior art since the area to be sealed is smaller and more advantageously shaped, as will be understood by one skilled in the art. Also, access panel 56*a* of furnace 10 need not provide a pressure seal at opening 58*a* because panel 56*a* is remote from heat exchanger 42. Leakage of air from enclosure 40 into the delivery air outside furnace 10 poses no health or safety risk to persons occupying the building. A sealing of panel 56*a* may be desired however, as will be understood by those skilled in the art, to increase efficiency by reducing leakage of heated circulation air from furnace 10. Furthermore, since panel 56*a* is not in direct contact with heat exchanger 42, heavy insulating of panel 56*a* is not required, such as is with plate 90 of the prior art.

Referring now to FIGS. 3 to 6, connection 53 may be of one of any of number of configurations. In one embodiment, shown in FIG. 3, connection 53 comprises a pair of mating, outwardly-turned flanges 100, disposed around open ends 102 and 104 of heat exchanger upper primary heat exchanger 49 and lower primary heat exchanger 51. A high temperature gasket 106 is placed between flanges 100 to facilitate maintenance of the desired pressure seal when flanges 100 are attached to one another. Upper primary heat exchanger 49 and lower primary heat exchanger 51 may be releasably fastened in any manner which maintains a pressure seal between flanges 100. Preferably a plurality of draw bolts 108 are provided, passing through holes 110 in flanges 100 and secured by nuts 111. Alternatively, holes 110 may be tapped to directly receive and engage bolts 108. Still other methods of fastening flanges 100 together may be used. For example, V-clamps or pinch clamps (not shown) may be used to secure flanges 100 together. Still other methods of fastening flanges 100 will be apparent to those skilled in the art, and the scope of the present invention should not be considered to be limited to the particular method of fastening flanges 100 together.

Figure 4:
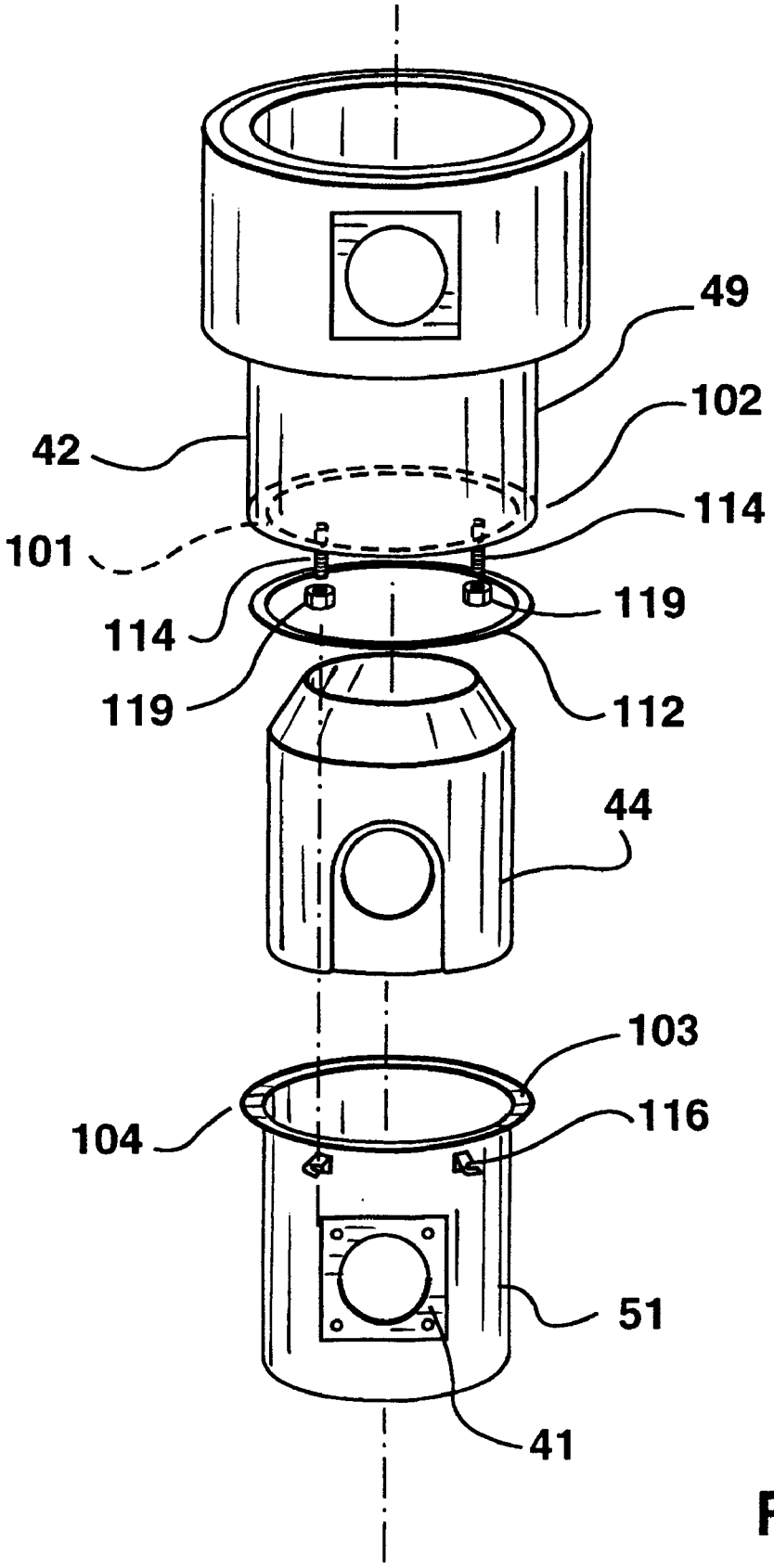
FIG. 4 is an exploded side view of the heat exchanger of FIG. 2, showing a preferred embodiment of the connection means of the present invention.
Figure 5:
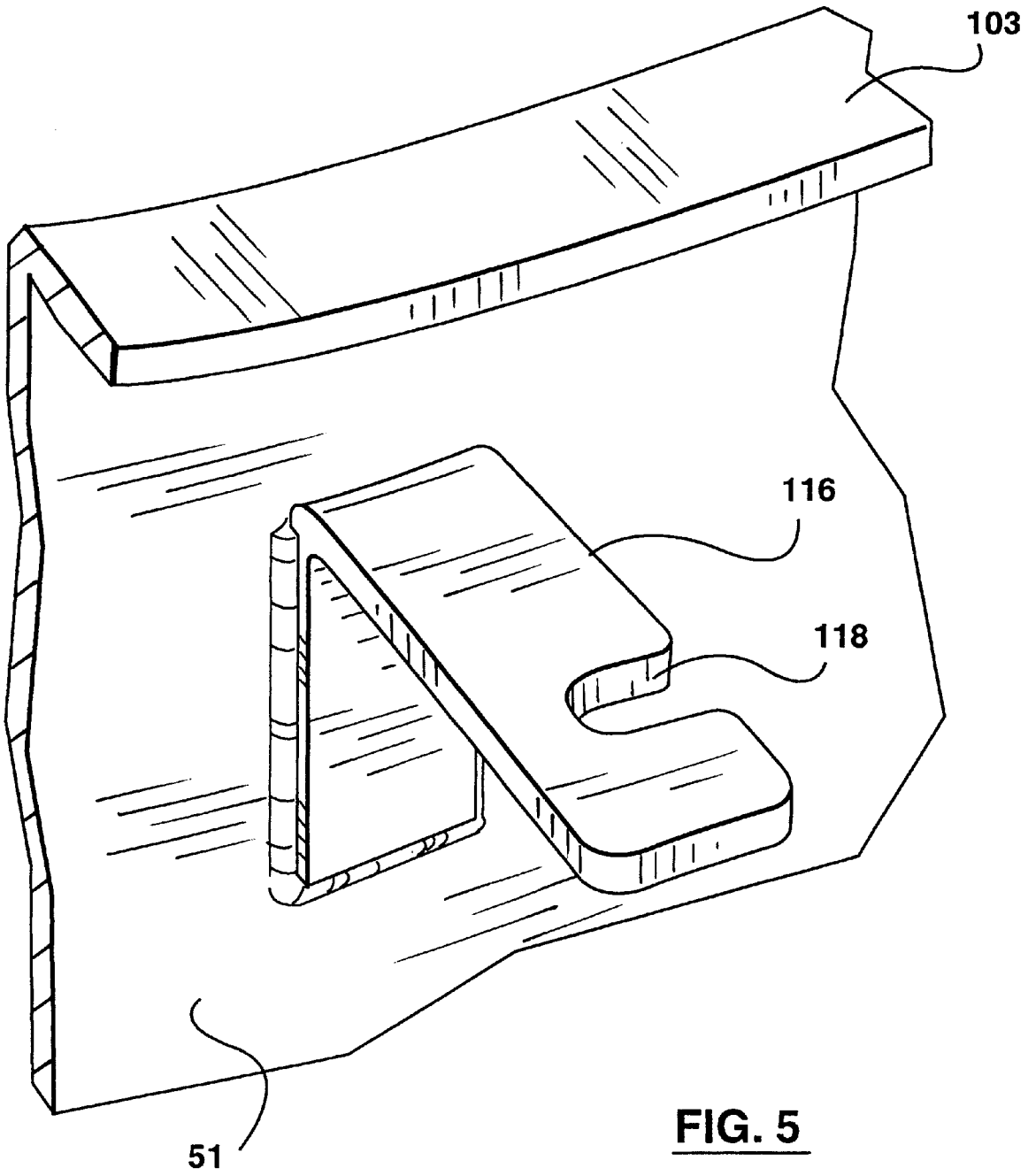
FIG. 5 is an enlarged isometric view of the bracket of the connection means of FIG. 4.

Referring to FIG. 4, the preferred embodiment of connection 53 is shown. In this embodiment, upper primary heat exchanger 49 has an inwardly-turning flange 101 around open end 102. Correspondingly, lower primary heat exchanger 51 has an outwardly-turning mating flange 103. Flange 103 may, if desired, be inwardly-turning as well. A high temperature gasket 112 is provided to seal the connection between flanges 101 and 103. A plurality of threaded studs 114, preferably four (4) in number, are welded to upper primary heat exchanger 49, in a spaced-apart manner such that the threads thereon depend downwardly below flange 101. A plurality of L-brackets 116 are welded to lower primary heat exchanger 51 at corresponding locations thereon. L-brackets 116 are installed below flange 103, such that there is no contact between the L-bracket and the flange, to avoid any distortion of flange 103 which might occur when connection 53 is tightened, as described below. L-brackets 116 each have a connection slot 118, sized to accept stud 114 (see FIG. 5). Slot 118 may be replaced by a simple hole 118, however a slot is preferred for reasons described below. A nut 119 is provided to secure stud 114 to L-bracket 116. To secure connection 53, lower primary heat exchanger 51 is positioned adjacent upper primary heat exchanger 49, studs 114 are positioned within slots 118, and nuts 119 are then secured to studs 114 to secure the connection. The connection is released by removing nuts 119.

Advantageously, the preferred embodiment of connection 53 permits easy installation and removal by one person. It will be understood that lower primary heat exchanger 51, with combustion chamber 44 located therein, has an appreciable weight requiring both hands of a service person to lift the unit into place for installation. Accordingly, the person has no free hand(s) available to install nuts 119 on studs 114. The use of slots 118 in preference to holes on L-bracket 116, however, allow nuts 119 to be pre-installed on studs 114, as long as sufficient room on stud 114 is left for the shaft of stud 114 to be easily slid into slot 118. Installation is, thus, achieved by pre-installing nuts 119 on studs 114, lifting and positioning lower primary heat exchanger 51 below upper primary heat exchanger 49 and then rotating lower primary heat exchanger 51 relative to upper primary heat exchanger 49 to slide studs 114 into slots 118. Once positioned in this manner, lower primary heat exchanger 51 will hang in place from nuts 119 and studs 114, permitting the service person to release lower primary heat exchanger 51 and use both hands (and the appropriate tool, if necessary) to tighten nuts 119 fully onto studs 114, thereby fully sealing connection 53.

Figure 6:
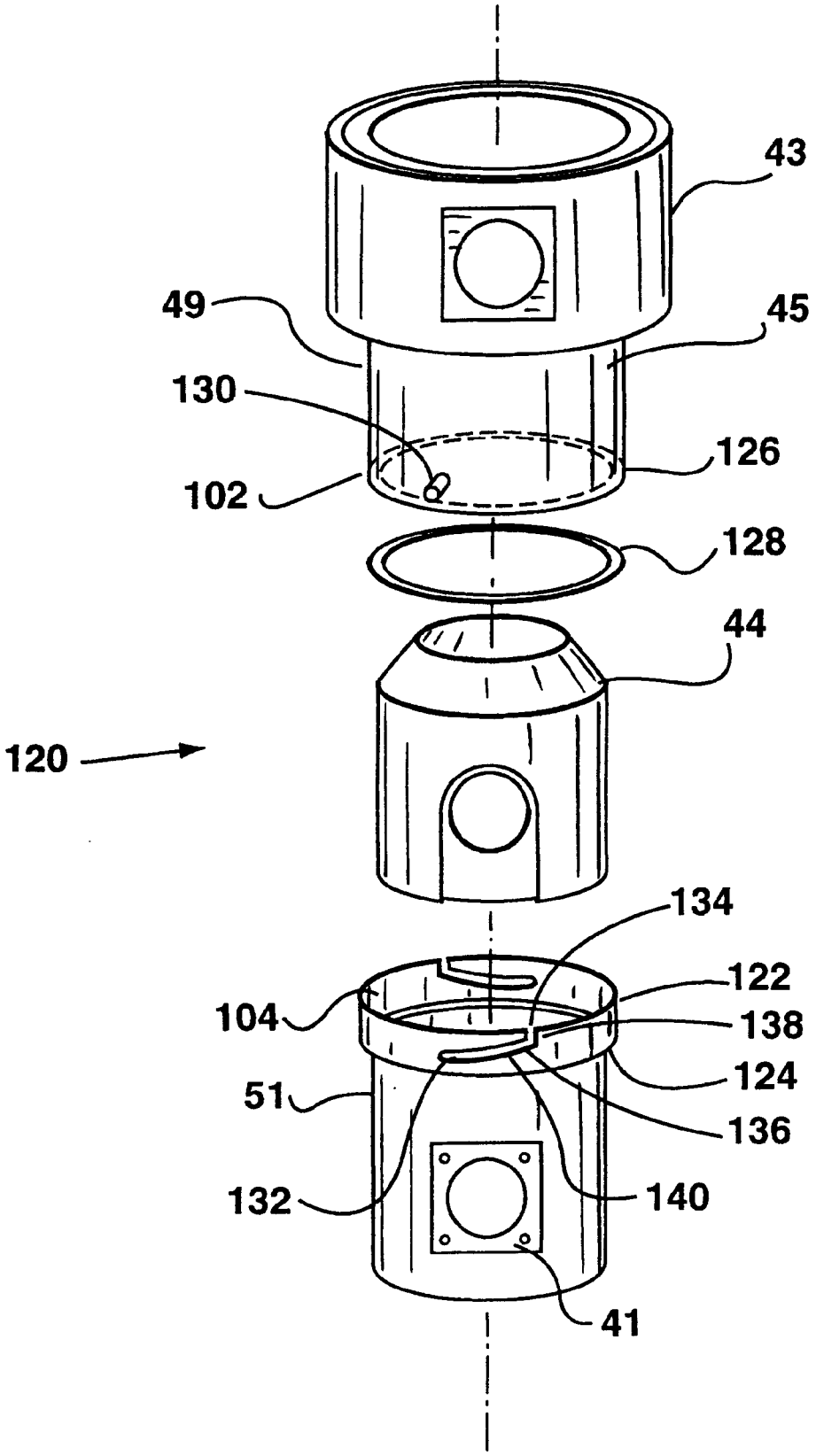
FIG. 6 is an exploded side view of the heat exchanger of the device of FIG. 2 showing a third embodiment of the connection means of the present invention.

Referring to FIG. 6, in a third embodiment upper primary heat exchanger 49 and lower primary heat exchanger 51 are connectable by a quick-locking means 120. In FIG. 6, a twist-locking joint is shown wherein open end 104 of lower primary heat exchanger 51 has a collar 122 with a shoulder 124. Upper primary heat exchanger 49 terminates in a lip edge 126 at end 102. A high temperature gasket 128 is provided, and seated on shoulder 124 of collar 122, to facilitate a pressure seal between upper primary heat exchanger 49 and lower primary heat exchanger 51, as described below. A plurality of locking pins 130 on upper primary heat exchanger 49 protrude horizontally outwardly from above lip edge 126. An equal number of pin ramps or locking slots 132 are disposed and positioned within collar 122 such that pins 130 may be simultaneously inserted into entry 134 of slots 132. Slots 132 have a path 136 which, when pins 130 are inserted into slots 132 through entry 134, and guided therethrough, lower primary heat exchanger 51 becomes securely attached to upper primary heat exchanger 49. Typically, path 136 will have a substantially straight vertical portion 138 followed by an approximately horizontal section 140. The depth of vertical portion 138 is chosen such that, when pins 130 are fully inserted therein, lip 126 of upper primary heat exchanger 49 should nearly abut shoulder 124, with gasket 128 therebetween.

Connection of upper primary heat exchanger 49 and lower primary heat exchanger 51 of the embodiment of FIG. 6 is achieved by positioning lower primary heat exchanger 51 below upper primary heat exchanger 49, such that pins 130 and slots 132 are aligned, and then raising lower primary heat exchanger 51 such that pins 130 enter vertical portion 138 of slots 132. The pins are then advanced along horizontal portion 140 of slots 132 by rotating lower primary heat exchanger 51 relative to upper primary heat exchanger 49. Advancing pins 130 through horizontal section 140 then eases lip 126 against shoulder 124. As will be understood by those skilled in the art, since a tight pressure seal is desired between upper primary heat exchanger 49 and lower primary heat exchanger 51, it is desirable to provide horizontal section 140 with a slightly sloping curved shape 136, as shown in FIG. 6. This shape results in a gently increasing axial pressure between lip 126 and shoulder 124 as lower primary heat exchanger 51 is twisted relative to upper primary heat exchanger 49, thereby facilitating hand-tightening of quick-locking means 120. When the quick-locking connection 53 is fully closed, a pressure seal of connection 53 is maintained by a firm engagement of lip 126 against gasket 128 and shoulder 124.

It will be understood by persons skilled in the art that other quick-locking means 120 may be used, and that the configuration of the twist locking means shown in FIG. 6, and described above, is intended in no way to limit the scope of the present invention. For example, collar 122 may be on upper primary heat exchanger 49, with locking pins 130 provided on lower primary heat exchanger 51. Also, it will be understood that any one of a number of path shapes 136 may be advantageously employed.

Yet other connection means for connection 53 may be advantageously employed without departing from the scope of the present invention.

Figure 7:
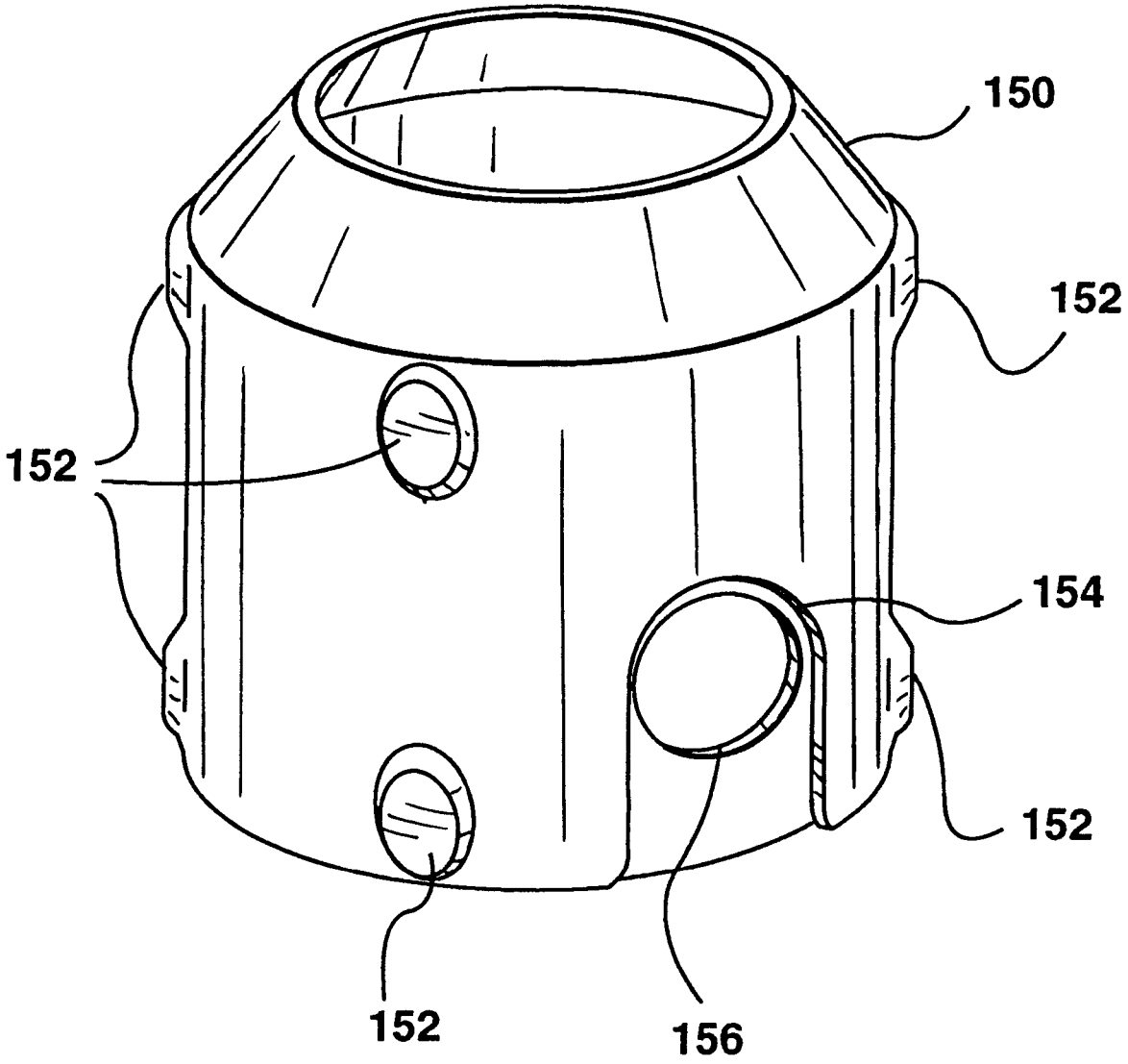
FIG. 7 is an isometric view of a preferred embodiment of a combustion chamber according to the present invention.

Referring to FIG. 7, the preferred embodiment of the present invention also includes a self-aligning combustion chamber 150. Self-aligning combustion chamber 150, which may be made of any material suitable for combustion chamber 44, has a plurality of centring bosses 152, a slot 154 and a combustion air tube inlet 156. Except for the presence of bosses 152 and slot 154, combustion chamber 150 is identical to combustion chamber 44. These features permit the quick and easy realignment of combustion chamber 150 in lower primary heat exchanger 51, after removal for service or replacement, as described below. Alignment and centring of the combustion chamber is important to ensure an even distribution of heat within heat exchanger 42, and for establishing the proper spacing between combustion air tube 48 and combustion air tube inlet 156. The importance of proper alignment to receive air tube 48 is self evident.

Figure 8:
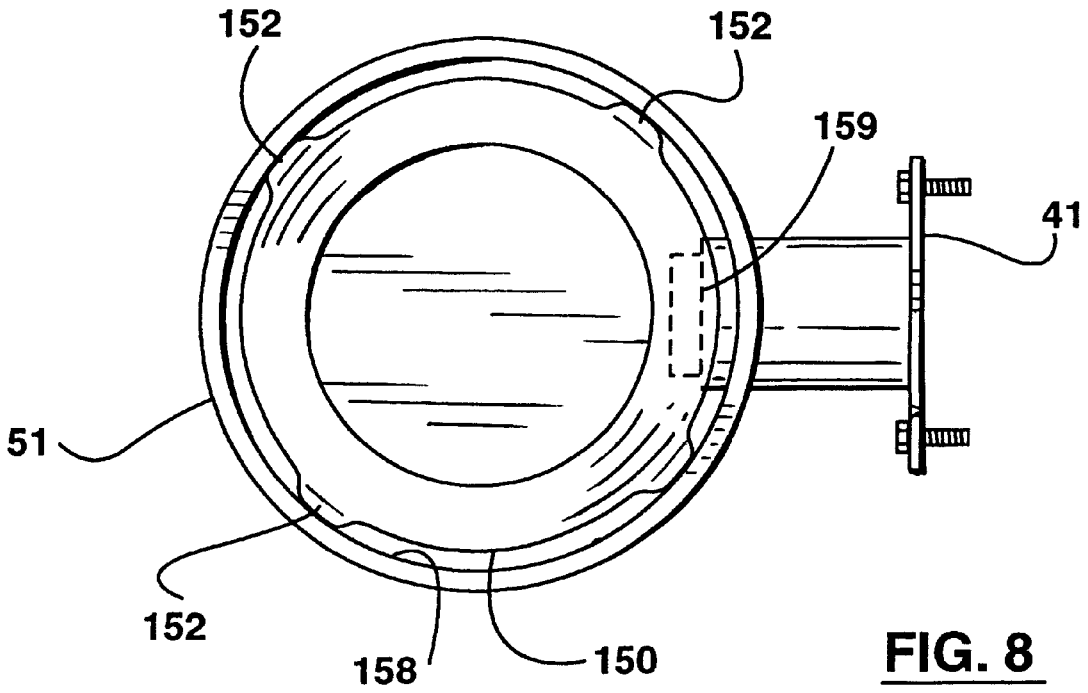
FIG. 8 is a top plan view of the combustion chamber of FIG. 7 located within the lower primary heat exchanger of the present invention.

Referring to FIGS. 7 and 8, preferably eight (8) bosses 152, comprising four (4) pairs of two (2), protrude from combustion chamber 150. Bosses 152 are sized to protrude form combustion chamber 150 a distance such that each boss 152 contacts, or approximately contacts, inner wall 158 of lower primary heat exchanger 51. Such contact guarantees the approximate centering of combustion chamber 150 in lower primary heat exchanger 51. One skilled in the art will appreciate that a minimum of three (3) bosses 152 must be employed, and any higher number may desired on combustion chamber 150 to achieve the self-centering result of the present invention.

Figure 9:
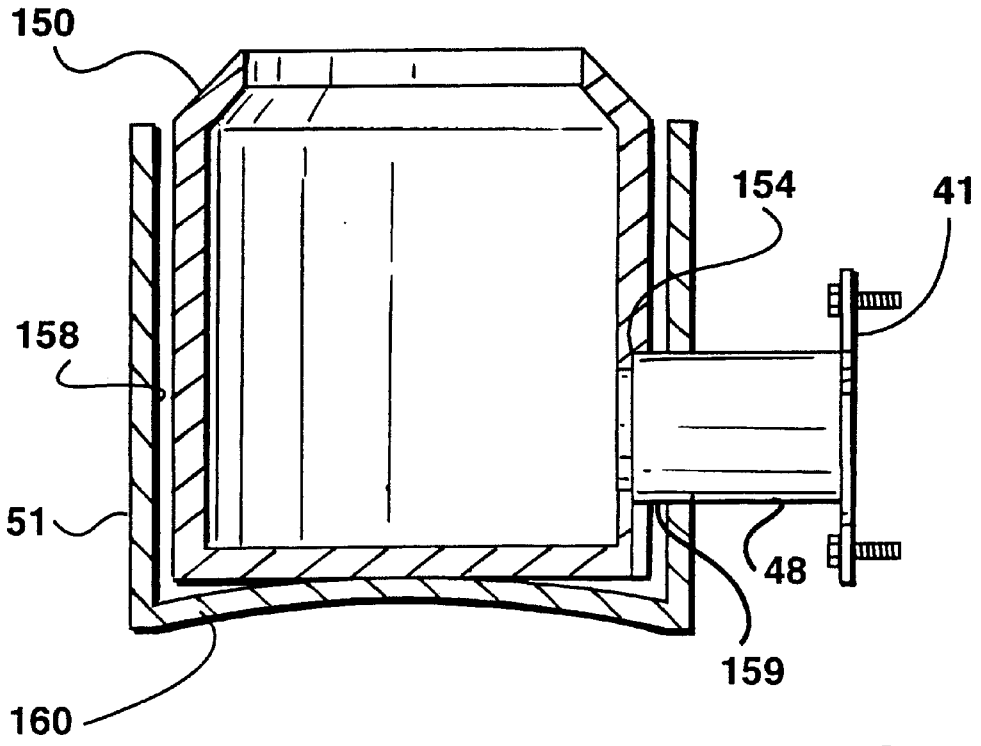
FIG. 9 is a sectional side view of the combustion chamber and lower primary heat exchanger of FIG. 8.

Referring to FIGS. 7 and 9, slot 154 is sized and positioned on combustion chamber 150 to matingly receive air tube 48 thereagainst. Air tube 48 is made to protrude slightly into lower primary heat exchanger 51, indicated at 159. Protrusion 159 causes air tube to interfere with combustion chamber 150 when insertion is attempted without recess slot 154 aligned to receive protrusion 159. Slot 154 and protrusion 159 cooperate in a typical slot-and-key fashion to align combustion chamber 150 in lower primary heat exchanger 51. The presence of slot 154 therefore permits service personnel to quickly and easily align combustion chamber 150 in lower primary heat exchanger 51 with the necessary orientation to receive combustion air tube 48.

Referring to FIG. 9, the preferred embodiment of the present invention also provides means to reduce corrosion of lower primary heat exchanger 51. It is well known in the art that the moisture in combustion gases condenses upon cooling, when furnace 10 is between operation cycles, resulting in condensate forming on the interior surface of primary heat exchanger 45. Such condensate tends to accumulate in lower primary heat exchanger 51, around combustion chamber 44. Given the preferred metal construction of lower primary heat exchanger 51, corrosion of lower primary heat exchanger 51 ultimately results. Advantageously, the preferred embodiment of lower primary heat exchanger 51 includes a dome-shaped bottom 160. Combustion chamber 150 rests on bottom 160, and well as contacting lower primary heat exchanger 51 with bosses 152, as described above. Combustion chamber 150 is, thus, stably positioned within lower primary heat exchanger 51, but advantageously permit combustion air to flow around a substantial portion of the outside surface of combustion chamber 150, including portions adjacent bottom 160. Such air circulation permits evaporation of combustion gas condensate, beneficially decreasing the tendency for corrosion of lower primary heat exchanger 51.

Heat exchanger 42 of the present invention provides a device which is more simple to manufacture and assemble than the prior art, and which also provides better heat exchange to the circulated air in enclosure 40. The presence of air tube 48 interferes only slightly with the passage of circulated air around heat exchanger 42, and much less so than duct 84 of the prior art. The corresponding increase in efficiency will permit the construction of a higher output furnace 10, or a furnace 10 having a smaller heat exchanger 42 than was possible in the prior art, or both. Furthermore, a complete pressure seal of heat exchanger 42 is achieved through the much simpler connection means of connection 53 disclosed herein. In particular, the circular shape of openings 102 and 104 in upper primary heat exchanger 49 and lower primary heat exchanger 51, respectively, facilitate a simpler pressure seal of heat exchanger 42, which advantageously removes the requirement of providing a pressure seal around a large rectangular access 62, as required in the prior art. For example, referring to the embodiment of FIG. 3, only four (4) to eight (8) fasteners are required to achieve a good pressure seal between flanges 100 of connection 53, whereas sealing opening 86 with plate 90 in the prior art required in excess of 20 fasteners. Accordingly, heat exchanger 42 of the present invention offers improvement over the prior art.

It will be understood that the present invention is equally applicable to various configurations and designs of forced-air hot air furnaces. For example, the present invention may be used in a lower profile furnace than that of FIG. 1, wherein blower 26 is located beside heat exchanger 24, rather than beneath it. Furthermore, although the preferred embodiment discloses use of the present invention in a hot-air furnace, it will be understood by one skilled in that art that, with certain modifications, the invention disclosed herein may equally used beneficially in water heaters and boilers.

While the above description constitutes the preferred embodiments, it will be appreciated that the present invention is susceptible to modification and change without departing from the fair meaning of the proper scope of the accompanying claims.

We claim:

1. A furnace for heating air, comprising:

(a) a casing having a base and side walls, the casing forming an enclosure having an interior circulation air space, and a cool air inlet and a warm air outlet;

(b) circulation means for introducing circulation air to the enclosure through the cool air inlet and removing circulation air from the enclosure through the warm air outlet;

(c) a heat source, comprising a burner and a combustion chamber located in the casing, the burner producing heat for heating the combustion chamber;

(d) a heat exchanger disposed within and spaced from the side walls of the casing for transferring heat from the combustion chamber to the circulation air, comprising a heat exchanger housing having an upper portion anchored to the casing and a lower portion depending from the upper portion, and connection means for releasably connecting the lower portion to the upper portion, the lower portion being configured and sized to removably receive the combustion chamber, the connecting means being configured and operable to sealingly suspend the lower portion from the upper portion, whereby releasing the connecting means enables the lower portion to be lowered and moved horizontally relative to the upper portion; and (e) access means formed, in one of the side walls of the casing, for providing access to the connection means, the access means comprising an accessway, configured and sized to permit removal of the lower portion of the heat exchanger from the enclosure therethrough when the connection means is released, and a cover for removably covering the accessway, the access means thereby permitting the lower portion of the heat exchanger to be separated from the upper portion and removed from the enclosure through the accessway, thereby facilitating servicing of the combustion chamber exterior to the casing.

2. The furnace of claim 1 wherein the connection means comprises a pair of mating flanges, one of the flanges attached to the upper portion and the other of the flanges attached to the lower portion, the flanges releasably fastenable to each other.

3. The furnace of claim 2, wherein the mating flanges are releasably fastenable by a plurality of fasteners engagable in the mating flanges.

4. The furnace of claim 2, wherein the mating flanges are releasably fastenable by a plurality of studs attached to the upper portion and being engageable in a plurality of brackets attached to the lower portion.

5. The furnace of claim 1, wherein the connection means comprises a quick release connection comprising a plurality of pins and slots on the upper and lower portions, the pins insertable into the slots such that, when inserted, the lower portion is secured to the upper portion.

6. The furnace of claim 2, wherein the combustion chamber is made of a refractory material.

7. The furnace of claim 1, wherein the burner is fuelled by heating oil.

8. The furnace of claim 1, wherein the burner is a gun-type burner.

9. The furnace of claim 1 wherein the combustion chamber has a plurality of raised members on an outer surface thereof for centering the combustion chamber in the lower portion.

10. The furnace of claim 1 wherein the combustion chamber has a slot corresponding to a key member attached to the lower portion for aligning combustion chamber in the lower portion.

11. The furnace of claim 1 wherein the lower portion has means for supporting the combustion chamber at a plurality of points to permit a flow of combustion air beneath a portion of the combustion chamber.

* * * * *